US007273156B2

(12) United States Patent
Gao et al.

(10) Patent No.: US 7,273,156 B2
(45) Date of Patent: Sep. 25, 2007

(54) ADJUSTABLE SHEET DISPENSER

(75) Inventors: Hongxia Gao, Appleton, WI (US); Gary Douglas Williams, Neenah, WI (US); Patricia Ann Samolinski, Winneconne, WI (US); Scott Allen Baum, Hortonville, WI (US); Sara Marie Vermillion, Menasha, WI (US); Daphne Lynn VanBuren, Greenville, WI (US); Tammy Jo Balzar, Oshkosh, WI (US); Cynthia Watts Henderson, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 318 days.

(21) Appl. No.: 10/860,357

(22) Filed: Jun. 2, 2004

(65) Prior Publication Data

US 2005/0269343 A1 Dec. 8, 2005

(51) Int. Cl.
*B65H 1/00* (2006.01)

(52) U.S. Cl. ..... 221/47; 221/63; 221/65

(58) Field of Classification Search ..... 221/47, 221/48, 63, 65

See application file for complete search history.

(56) References Cited

U.S. PATENT DOCUMENTS

| | | | | |
|---|---|---|---|---|
| 601,144 | A | 3/1898 | Howe | |
| 1,218,196 | A | 3/1917 | Mccorkindale | |
| 2,011,403 | A | 8/1935 | Gessler | |
| 2,083,868 | A * | 6/1937 | Rottman | 229/101 |
| 2,253,742 | A | 8/1941 | West et al. | |
| 2,287,420 | A | 6/1942 | Edmonston | |
| 2,501,357 | A | 3/1950 | Speckman et al. | |
| 2,522,427 | A | 9/1950 | Borden | |
| 2,598,050 | A | 5/1952 | Reynolds | |
| 2,634,855 | A | 4/1953 | Mandel | |
| 2,636,599 | A | 4/1953 | Willis et al. | |
| 2,802,567 | A | 8/1957 | Covel | |
| 2,849,152 | A | 8/1958 | Tuttle | |
| 2,858,045 | A | 10/1958 | Loeb | |
| 3,145,840 | A * | 8/1964 | Wright | 206/494 |
| 3,197,062 | A | 7/1965 | Day et al. | |
| 3,202,316 | A | 8/1965 | Silver | |
| 3,221,928 | A * | 12/1965 | Horn | 221/34 |
| 3,224,633 | A | 12/1965 | Dayton | |
| 3,349,959 | A | 10/1967 | Watkins | |
| 3,425,595 | A | 2/1969 | Shapira | |

(Continued)

FOREIGN PATENT DOCUMENTS

GB 2 363 372 A 12/2001

(Continued)

*Primary Examiner*—David H. Bollinger
(74) *Attorney, Agent, or Firm*—Scott A. Baum

(57) ABSTRACT

A dispenser for sheet materials includes a top portion, a bottom portion, and a restraining member preventing the top and bottom portion from separating. The top portion and the bottom portion can telescope to vary the dispenser's overall height. In one embodiment, by designing a dispenser having bottom sidewalls and top sidewalls of approximately the same length, problems with access to the exposed sheet or excessive manipulation to change the dispenser's height can be avoided. In another embodiment, by designing the dispenser such that the height of the dispenser can automatically reduce as the sheet material is depleted or where the height can be adjusted by simply pushing down on the dispenser's top makes the dispenser convenient to use.

24 Claims, 4 Drawing Sheets

U.S. PATENT DOCUMENTS 3,459,329 A 8/1969 Mochizuki et al.
3,603,452 A 9/1971 Singer
3,604,562 A 9/1971 Loeffler
3,606,082 A 9/1971 Kuchenbecker
3,647,114 A 3/1972 Bleuer
3,765,565 A 10/1973 Fietzer et al.
3,784,055 A 1/1974 Anderson
3,942,682 A 3/1976 Mckay
D278,684 S * 5/1985 Sussman ..... D9/733
4,586,631 A 5/1986 Loder
4,616,767 A 10/1986 Seido
4,913,312 A 4/1990 Boutin
4,969,575 A 11/1990 Kobayashi
5,065,936 A 11/1991 King
5,129,545 A 7/1992 Parks
5,197,631 A 3/1993 Mishima
5,215,757 A 6/1993 El-Nokaly
5,332,117 A 7/1994 Yadegar
5,363,985 A 11/1994 Cornell
5,390,820 A 2/1995 Wright et al.
5,599,555 A 2/1997 El-Nokaly
5,819,944 A 10/1998 Terrasi
5,967,321 A 10/1999 Sigl
5,979,699 A 11/1999 Simpson
5,979,700 A 11/1999 Suess
5,980,931 A 11/1999 Fowler et al.
5,992,683 A 11/1999 Sigl
6,068,583 A 5/2000 Sigl
6,121,165 A 9/2000 Mackey et al.
6,283,295 B1 9/2001 Akutagawa et al.
6,296,143 B1 10/2001 Ghabriel
6,390,820 B1 5/2002 Landman
6,520,371 B2 2/2003 Cheng
6,550,636 B2 4/2003 Simpson
6,648,172 B2 11/2003 Leighton et al.
6,672,475 B1 1/2004 Ho et al.

FOREIGN PATENT DOCUMENTS

JP 06-080173 A 3/1994
JP 10-316182 A 12/1998

* cited by examiner

ADJUSTABLE SHEET DISPENSER

BACKGROUND

Sheet materials, such as tissue paper and wet wipes, are often interfolded into stacks or clips and placed into a dispenser such that upon removal of one sheet, a subsequent sheet is partially dispensed having an exposed portion that extends from the dispenser's opening. This method of "pop-up" sheet dispensing is convenient for many applications, since the next sheet is readily presented for quick access. However, the pop-up sheet dispensing feature can become unreliable as the height of the dispenser increases and/or the stack height of the remaining sheets decreases. When this occurs, the partially dispensed sheet can "fall-back" into the dispenser's interior where it is inconvenient to reach. Frequently, the dispensing opening's design prohibits easy access to the substrate to restart the pop-up dispensing feature. In facial tissue dispensers, the opening and the poly window used to hold the popped-up sheet in position can be damaged or destroyed when reaching into the dispenser to retrieve the fallen sheet. The damage can cause additional incidences of fall-back to occur and prevent the substrate from staying in position ready to dispense.

Various dispensers have been designed to solve this problem. Some dispensers use biasing springs to lift the sheet material towards the opening, movable bottoms that lift the sheet material, or other methods to force the clip against the dispensing opening to ensure more reliable dispensing. While such methods can reduce the incidence of dispensing failures due to fall-back, the dispensers tend to be expensive or require inconvenient manipulation of the dispenser during use to prevent fall-back from occurring. Also, some executions have an additional opening into the bottom or sides of the dispenser for sheet removal as the sheets are depleted that, can be negatively perceived by people using the dispenser as unsanitary. In general, people would prefer not to adjust or manipulate the dispenser during use. They merely want to dispense a sheet reliably from the start until all the sheets have been dispensed without having to adjust the dispenser.

A collapsible box for facial tissue is disclosed in U.S. Pat. No. 3,224,633 entitled Collapsible Box for Facial Tissues issued to Allen on Dec. 21, 1965. The upper part of the box has several perforated tear away portions or strips to reduce the overall height of the dispenser. In order to reduce the height of this dispenser, the upper part of the box must be torn away while the lower tray is progressively located closer to the top of the box. This can help reduce the incidence of fall-back; however, such a dispenser is not convenient to use. Excessive manipulation is required to progressively move the lower tray in a series of small steps because the lower tray has a relatively short sidewall as compared to the much longer sidewall on the upper portion that is torn away each time the lower tray is moved.

Another dispenser for stacked sheets is disclosed in U.S. Pat. No. 3,349,959 entitled Box for Dispensing Stacked Sheets issued to Watkins on Oct. 31, 1967. In this dispenser, the cover section of the dispenser with the dispensing opening can be removed and pushed down into the bottom section as the stack of sheets is depleted. This can help reduce the incidence of fall-back; however, the cover has a relatively short sidewall as compared to the sidewall of the bottom section. As a result, when the stack is nearly depleted the sheets are dispensed from within the confines of the bottom section since the longer bottom sidewall extends significantly above the cover. This reduces access to the popped-up sheet since it can no longer be reached or grabbed from the side, but instead must be grabbed only from the top by reaching into the bottom section. Furthermore, this dispenser can trap dirt, dust, or lint in the bottom section since the bottom sidewall extends significantly above the cover as the cover drops into the bottom section creating a cavity that can trap debris.

Therefore, what is needed is an economical dispenser that reduces the incidence of fall-back and also avoids the problems with prior dispensers. Also what is needed, is a dispenser that is either self adjusting or that can be adjusted with a minimum of manipulation.

SUMMARY

A dispenser for sheet materials includes a top portion, a bottom portion, and a restraining member preventing the top and bottom portion from separating. The top portion and the bottom portion can telescope to vary the dispenser's overall height. In one embodiment, by designing a dispenser having bottom sidewalls and top sidewalls of approximately the same length, problems with access to the exposed sheet or excessive manipulation to change the dispenser's height can be avoided. In another embodiment, by designing the dispenser such that the height of the dispenser can automatically reduce as the sheet material is depleted or where the height can be adjusted by simply pushing down on the dispenser's top makes the dispenser convenient to use.

Hence in one embodiment, the invention resides in a dispenser comprising: a bottom portion including a bottom panel and a bottom sidewall extending from the bottom panel and having a bottom sidewall height; a top portion having a top panel and a top sidewall extending for the top panel and having a top sidewall height; a dispensing opening located in the top panel; the bottom portion at least partially nested within the top portion such that an overall height of the dispenser can be reduced as the top portion moves relative to the bottom portion; a restraining member preventing the bottom portion and the top portion from separating; and wherein a ratio of the bottom sidewall height to the top sidewall height is between about 0.7 to about 1.3.

In another embodiment, the invention resides in a dispenser comprising: a bottom portion including a bottom panel and a bottom sidewall extending from the bottom panel and having a bottom sidewall height; a top portion having a top panel and a top sidewall extending for the top panel and having a top sidewall height; a dispensing opening located in the top panel; the top portion at least partially nested within the bottom portion such that an overall height of the dispenser can be reduced as the top portion moves relative to the bottom portion; a restraining member preventing the bottom portion and the top portion from separating; and wherein a ratio of the bottom sidewall height to the top sidewall height is between about 0.7 to about 1.3.

In another embodiment, the invention resides in a dispenser comprising: a bottom portion including a bottom panel and a bottom sidewall extending from the bottom panel and having a bottom sidewall height; a top portion having a top panel and a top sidewall extending from the top panel and having a top sidewall height; a dispensing opening located in the top panel; the bottom portion and top portion having the ability to telescope changing an overall height of the dispenser, and a restraining member comprising a flexible substrate preventing the bottom portion and the top portion from separating.

In another embodiment, the invention resides in a dispenser comprising: a bottom portion including a bottom panel and a bottom sidewall extending from the bottom panel and having a bottom sidewall height; a top portion having a top panel and a top sidewall extending from the top panel and having a top sidewall height; a dispensing opening located in the top panel; the bottom portion and top portion having the ability to telescope changing an overall height of the dispenser, and a restraining member comprising a lower projection on the bottom sidewall and an upper projection on the top sidewall preventing the bottom portion and the top portion from separating.

BRIEF DESCRIPTION OF THE DRAWINGS

The above aspects and other features, aspects, and advantages of the present invention will become better understood with regard to the following description, appended claims, and accompanying drawings in which:

Figure 1:
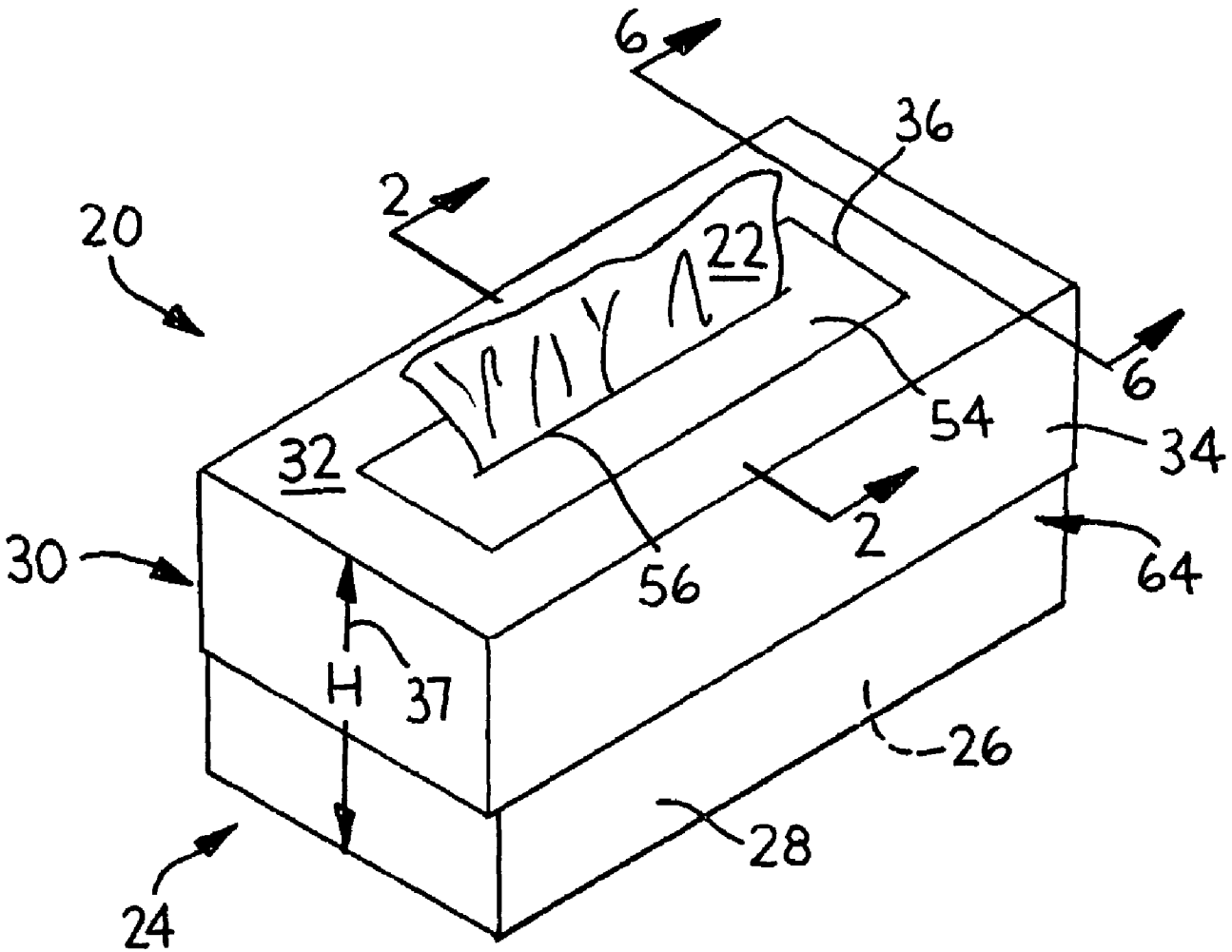
FIG. 1 illustrates a dispenser for substrates.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "restraining member" is one or more elements that prevent the top portion and the bottom portion of the dispenser from completely separating from each other due to the restraining member's action when the dispenser and its contents are lifted off a surface by only the top portion. The restraining member is intended to prevent the top and bottom portion from separating during the dispenser's normal movements in use, such as when moving the dispenser from one location to another location, while still allowing for the height of the dispenser to be adjusted. The restraining member may not prevent separation of the top and bottom portions during extreme handling situations such as excessive shaking, hard impacts with other objects during a fall, or when hanging the dispenser by the top portion for an extended period of time where temperature or humidity changes could have an affect on the restraining member's ability to continue holding the top and bottom portion together. A restraining member can include, but is not limited to, a physical projection extending or interlocking with another projection or aperture, coil springs on the upper or lower portion in compressive contact with the other portion of the dispenser, such as the sidewall, a strap or other flexible substrate attaching the upper and lower portions, an adhesive or cohesive bond holding the portions together while still allowing them to also be repositioned, a coating that increases the sliding friction between the two portions, or a sliding interference fit that creates sufficient friction to hold the two portions together.

As used herein, "sheet material" is a flexible substrate, which is useful for household chores, cleaning, personal care, health care, food wrapping, and cosmetic application or removal. Non-limiting examples of suitable substrates for use with the dispenser include nonwoven substrates; woven substrates; hydro-entangled substrates; air-entangled substrates; paper substrates comprising cellulose such as tissue paper, toilet paper, or paper towels; waxed paper substrates; coform substrates comprising cellulose fibers and polymer fibers; wet substrates such as wet wipes, moist cleaning wipes, moist toilet paper wipes, and baby wipes; film or plastic substrates such as those used to wrap food; shop towels; and metal substrates such as aluminum foil. Furthermore, laminated or plied together substrates of two or more layers of any of the preceding substrates are also suitable.

As used herein, "wet sheet material" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate issued to Fowler et al. on Nov. 9, 1999. Other suitable wet sheet materials can have encapsulated ingredients such that the capsules rupture during dispensing or use. Examples of encapsulated materials include those disclosed in U.S. Pat. No. 5,215,757 entitled Encapsulated Materials issued to El-Nokaly on Jun. 1, 1993, and U.S. Pat. No. 5,599,555 entitled Encapsulated Cosmetic Compositions issued to El-Nokaly on Feb. 4, 1997. Other suitable wet sheet materials include dry substrates that deliver liquid when subjected to in-use shear and compressive forces. Such substrates are disclosed in U.S. Pat. No. 6,121,165 entitled Wet-Like Cleaning Articles issued to Mackay et al. Sep. 19, 2000.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Figure 2:
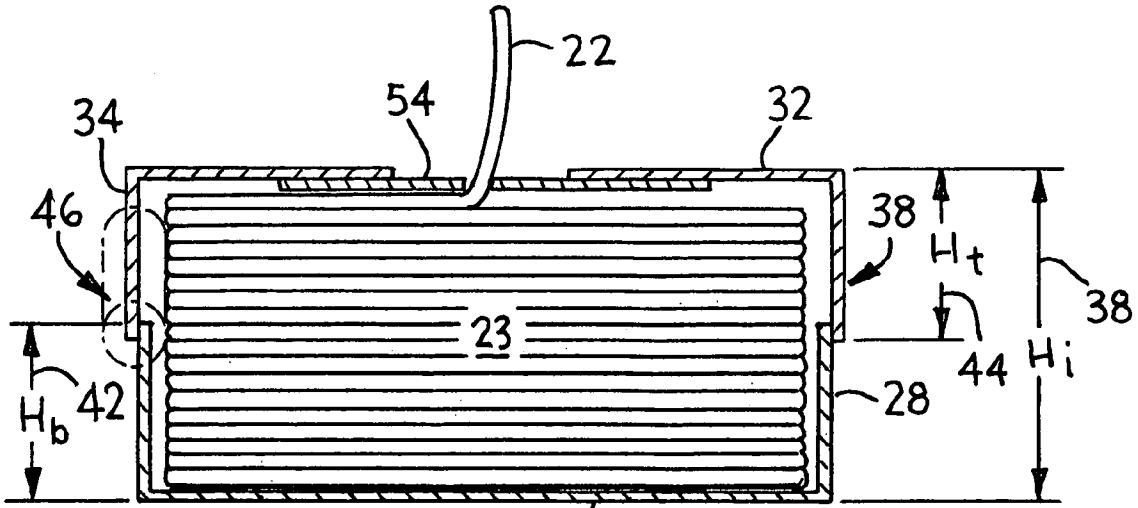
FIG. 2 illustrates a cross-section of one embodiment of FIG. 1 taken at line 2—2.
Figure 3:
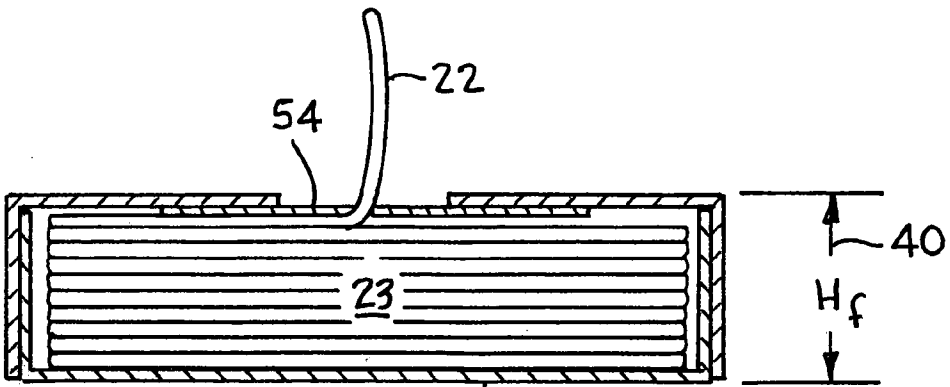
FIG. 3 illustrates a cross-section taken of FIG. 1 taken at line 2—2 after being collapsed.

Referring to FIGS. 1, 2, and 3, one embodiment of a dispenser 20 for sheet material 22 is illustrated. The dispenser can be used to dispense dry or wet sheet material. In one embodiment, the dispenser housed a folded stack 23 of sheet material. The folded stack can be folded to provide either reach-in or pop-up dispensing of the sheet material that, in one embodiment, comprised pop-up dispensing for multiple facial tissue sheets. In another embodiment, the dispenser housed a folded stack of tissue sheets and was a reach-in dispenser where the sheet material did not pop-up. The dispenser includes a bottom portion 24 having a bottom panel 26 and a bottom sidewall 28 extending from the bottom portion. The dispenser also includes a top portion 30 having a top panel 32 and a top sidewall 34 extending from the top panel. A dispensing opening 36 is located in the top panel. If desired, a dispensing window 54 with a slit 56 cut into the dispensing window can be located in the dispensing opening. The dispensing window can be made of plastic, film, paper, nonwovens, or other flexible substrate that assists in holding the exposed sheet in place.

If the dispenser is used to dispense wet sheet material, an appropriate cover or cap can be used to close the dispensing opening to prevent the substrate from drying out. For example, a flexible cover having a suitable pressure sensitive adhesive can be used. Alternatively, a rigid flip-type cover or cap can be attached to the dispenser. Alternative covers for retaining moisture while dispensing sheet materials are readily known to those of ordinary skill in the art.

The top portion and bottom portion are nested together such that an overall height H (37) of the dispenser can be adjusted from an initial height $H_i$ (38) to a final height $H_f$ (40). In the illustrated embodiment, the bottom portion 24 telescopes or nests within the top portion 30. In an alternative embodiment, the top portion 30 can telescope or nest within the bottom portion 24. The shape of the sidewalls or the overall dispenser is not critical as long and the top portion and bottom portion can telescope or nest together.

By reducing the overall height of the dispenser, improved tissue dispensing can result from reducing or eliminating sheets from falling back into the interior of the dispenser. The improvement is believed to occur since a shorter distance between the stack of interfolded sheets and the dispensing opening increases the likelihood that the dispensed sheet will remain in frictional contact with the following sheet long enough to pull the following sheet partially through the dispensing opening.

Additional advantages for a dispenser having an adjustable height include: signaling a person the dispenser is nearing depletion because the dispenser is adjusted to its lowest position, providing for a dispenser that can initially be used in one location having a high usage rate and then located in another location having a different usage rate or where a smaller dispenser is desired such as moving the dispenser from one's home to their car, an aesthetic advantage by providing a more compact dispenser as the sheet material is depleted, or reducing the empty/depleted look of the dispenser for reach-in dispensing as the sheet material is removed.

The bottom sidewall has a bottom sidewall height $H_b$ (42) and the top sidewall has a top sidewall height $H_t$ (44). In one embodiment, to reduce the number of times the dispenser needs to be adjusted, the bottom sidewall height $H_b$ and the top sidewall height $H_t$ are approximately equal. The dispenser is adjusted just once from the initial height $H_i$ to the final height $H_f$ when approximately half of the sheets have been dispensed thereby reducing the overall height of the dispenser by approximately one-half. In an alternative embodiment, when the top portion is nested within the bottom portion, the bottom sidewall can end approximately even with the top panel when the dispenser is at its lowest height, improving access to the sheet material. This eliminates forming a cavity above the top panel if the bottom sidewall extends past the top panel when the dispenser is adjusted to its lowest height. The cavity can collect dust or other debris and restrict access to the exposed sheet.

In various embodiments of the invention, a ratio of the bottom sidewall height $H_b$ to the top sidewall height $H_t$, $H_b/H_t$, can be between about 0.6 to about 2, between about 0.7 to about 1.3, between about 0.8 to about 1.2, between about 0.9 to about 1.1, or between about 0.95 to about 1.05. In certain embodiments, it can be more desirable to have the ratio closer to 1.0 to maximize the overall height reduction while minimizing the number of times the dispenser needs to be manipulated. In other embodiments, sidewalls can have, larger differences in height to accommodate the various types of restraining members or to allow the height of the dispenser to be adjusted more than once. In one embodiment, the top sidewall height $H_t$ was equal to the bottom sidewall height $H_b$. In the various embodiments, some variation in the sidewall heights can be tolerated to accommodate for the thickness of the top and bottom panels, and to help seal the top portion to the bottom portion as will be discussed later.

The initial height $H_i$ of the dispenser can be any size needed based upon the necessary capacity of the dispenser for the number of sheets desired and the volume required based on the sheet's thickness and the way the sheets are folded. In some embodiments, the dispenser can have an initial height $H_i$ between about 1 inch to about 24 inches, between about 1 inch to about 18 inches, or between about 1 inch to about 6 inches. The final height of the dispenser $H_f$ will depend on how much of the top or bottom portion nests within the other portion at the lowest position of the dispenser and the ratio of the sidewall heights. In some embodiments of the invention, the dispenser can have a final height $H_f$ between about ½ inch to about 12 inches, between about ½ inch to about 9 inches, or between about ½ inch to about 3 inches.

The dispenser also includes a restraining member 46 preventing the top portion and the bottom portion from completely separating while still allowing the top and bottom portions to telescope relative to each other. The restraining member can comprise projections extending from the upper and lower sidewalls, tabs on one portion and slots on the mating portion, a flexible substrate attached to both the top and bottom portions, or adhesive or cohesive coating or treatment of the sidewalls, mechanical fasteners such as hook and loop material with one sidewall exhibiting loop behavior and the other sidewall having projections for engaging with the loop material. The restraining member can be made from the same material as the dispenser such as protrusions formed by punching out portions of the sidewall to form projections or the restraining member can be an added element or different material such as a friction coating or a flexible strap.

Figure 4A:
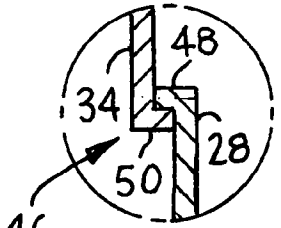
FIG. 4A illustrates a cross-section enlargement of one embodiment of a restraining member taken from the dashed circle in FIG. 2.
Figure 4B:
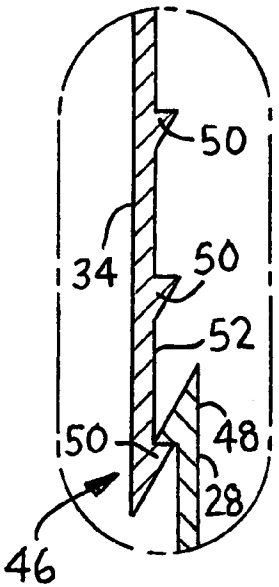
FIG. 4B illustrates a cross-section enlargement of another embodiment of a restraining member taken from the dashed ellipse in FIG. 2.

Two possible embodiments for the restraining member 46 are illustrated in FIGS. 4A and 4B. In the illustrated embodiments, the restraining member comprises a lower projection 48 on the bottom sidewall and an upper projection 50 on the top sidewall. The upper and lower projections extend from the respective sidewalls and engage with each other, thereby preventing the top and bottom portions from, completely separating when picking up the dispenser to move or relocate the dispenser. In one embodiment, the projections can be disengaged by squeezing one of the sidewalls to separate the top and bottom portions for refilling the dispenser with new sheet material. The cross-section of the projections can be either an "L" shape as illustrated in 4A or a "triangular" shape as illustrated in 4B. Other cross-sections for the projections can be used such as half-round, oval, or square. The projections can be formed by attaching restraining members along at least a portion of the perimeter of each sidewall near the free end of the sidewall. Alternatively, portions of the sidewall itself can be punched out to engage with the other sidewall.

If desired, additional projections can be located on either the upper or lower sidewalls, depending on which portion is intended to telescope. For example, the upper projection in FIG. 4B comprises at least two upper projections along the top sidewall with a gap 52 between any two projections. The purpose of providing multiple projections is to enable the top or bottom portion to be quickly and easily adjusted to various intermediate heights. The triangular profile, or other profile for the restraining member that permits the upper and lower projections to slide past one another in one direction, while still preventing the top portion and bottom portion from separating in an opposing direction can be used. Because the lower projection 48 resides in the gap 52 between two of the upper projections 50, the top and bottom portions are prevented from separating. When it is desired to lower the top portion, a force is applied to the top panel that causes the lower projection to slide past one of the upper projections and into the next gap. With the lower projection now captured in the next gap, the height of the box is lowered and the bottom portion is still prevented from separating when lifting the top portion. This provides for a fast and convenient method of adjusting the overall height of the dispenser. The top portion can be quickly "ratcheted downward" in a series of steps by pressing down on the top portion. This avoids having to pick up the dispenser to change its height or performing other excessive manipulations to adjust the height of the dispenser.

Figure 5:
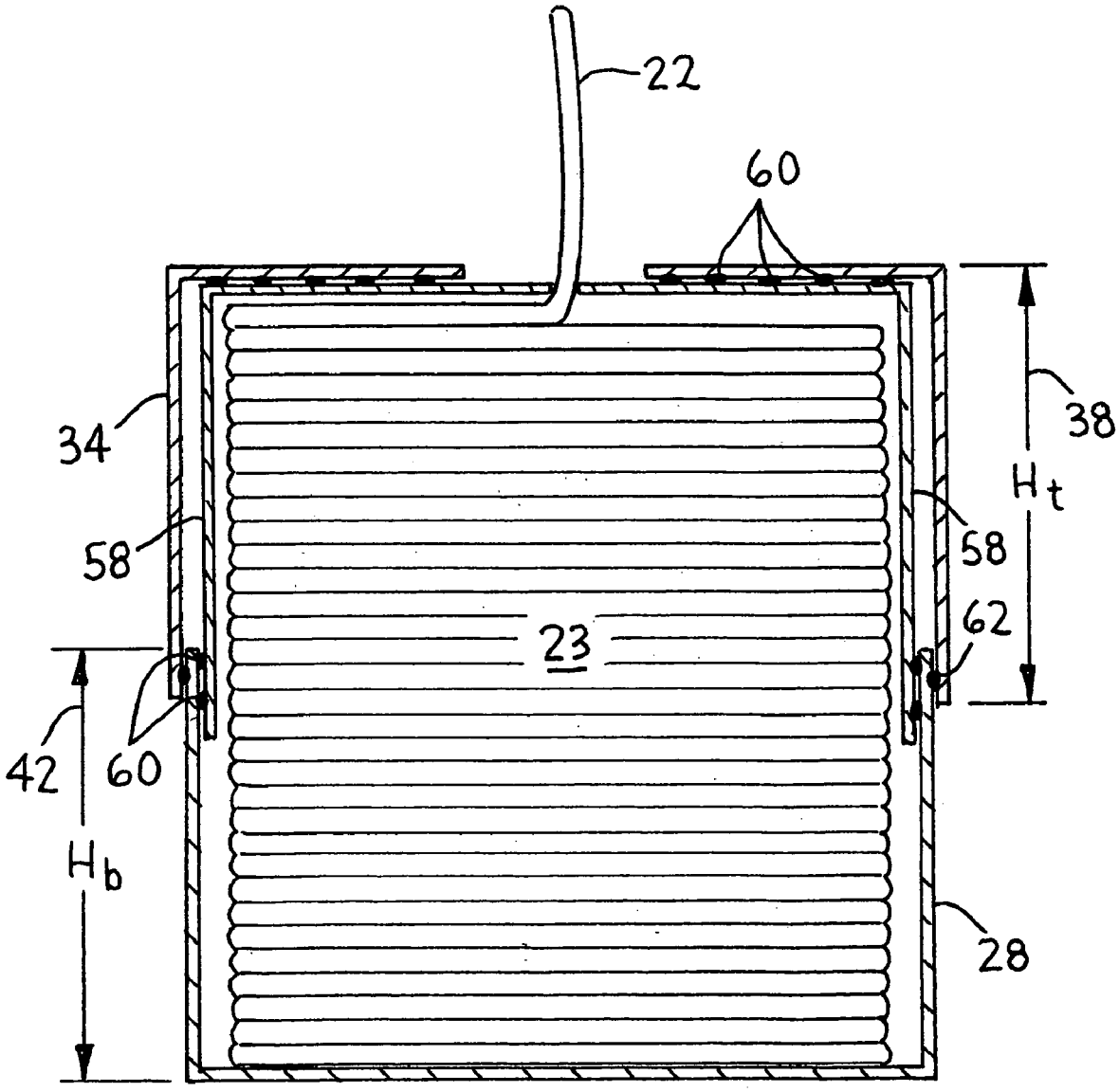
FIG. 5 illustrates a cross-section of another embodiment of FIG. 1 taken at line 2—2.

Referring now to FIGS. 1 and 5, another embodiment for the dispenser is shown. The top portion 30 and the bottom portion 24 are held together by a restraining member 46 comprising a flexible substrate 58. The flexible substrate can comprise plastics, films, paper, nonwovens, woven substrates, strings, bands, or other materials that will readily collapse when a compressive force is applied. In the illustrated embodiment, the flexible substrate comprised an extension of the poly film dispensing window 54. The dispensing window restraining member is attached to the top panel 32 and attached to the bottom sidewall 28. An adhesive 60 can be used to attach the flexible substrate to the various locations within the dispenser. Because the flexible substrate is not attached to the top sidewall 34, the bottom portion can telescope into the top portion and the flexible substrate will collapse when a force is applied to the top panel. The flexible substrate prevents the top and bottom portions from completely separating when moving or relocating the dispenser since the flexible substrate connects the top portion to the bottom portion.

Figure 6:
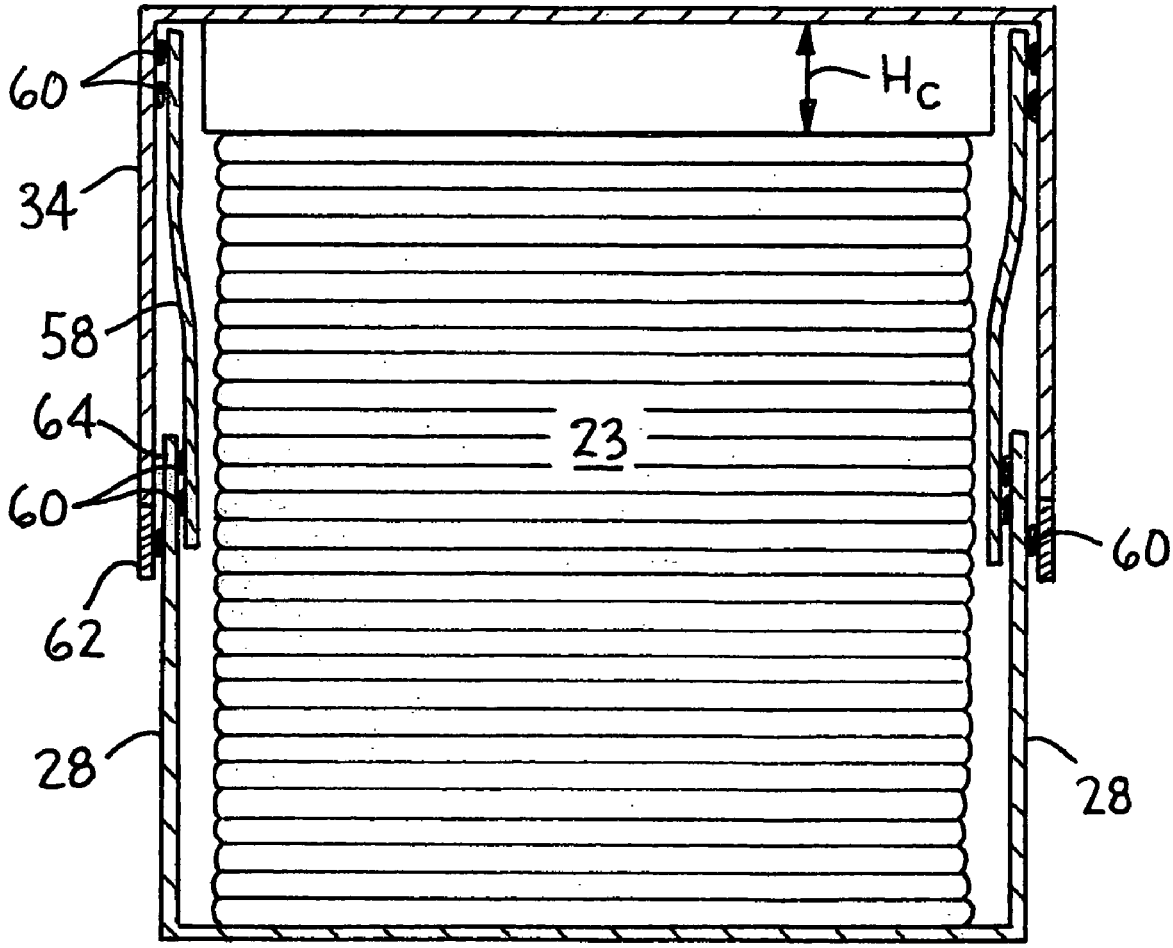
FIG. 6 illustrates a cross-section of another embodiment of FIG. 1 taken at line 6—6.

In an alternative embodiment illustrated in FIGS. 1 and 6, the flexible substrate restraining member 58 is attached to the top sidewall 34 near the top panel 32 and to the bottom sidewall 28. If desired, a separate flexible substrate can be used to form a dispensing window 54. The bottom portion can still telescope into the top portion in this embodiment. The ratio of the bottom sidewall height to the top sidewall height can be adjusted to accommodate for the slight reduction in the amount of space available for the lower sidewall to occupy when the dispenser is fully collapsed.

If desired, any of the dispensers in FIGS. 1–6 can be provided with a seal 62 between the top sidewall and the bottom sidewall that initially prevents movement of the top portion relative to the bottom portion until the seal is broken. The seal can comprise a break away adhesive or cohesive seal (FIG. 5), or a removable tear strip (FIG. 6) that can be peeled from the dispenser. The seal can be used to provide more integrity to the dispenser when subjected to machinery for automated loading of the dispenser with sheet materials and to prevent collapse of the dispenser during shipment. The seal can then be broken either just before adjusting the height of the dispenser or when initially dispensing the first sheet.

If desired, any of the dispensers in FIGS. 1–6 can be provided a fit 64 (FIG. 6) between the top portion and the bottom portion that can be sized to control the telescoping action of the dispenser. In one embodiment, the fit comprises a clearance between the top sidewall and the bottom sidewall such that the top portion of the dispenser can automatically lower as the stack of sheets is depleted. The weight of the top portion can be adjusted to keep the top portion from excessively lifting off the stack during sheet dispensing. If needed, additional layers of material forming the top portion, denser materials, or weights can be added to the top portion to ensure reliable operation. By having a weighted top portion contact the stack during sheet dispensing, the frictional engagement of successive sheets within the stack can be increased, thereby increasing the reliability of the pop-up dispensing feature while also ensuring the frictional contact between the sheet and the dispenser is low enough to prevent or minimize tearing of the sheet material during dispensing.

In another embodiment, the fit 64 comprises an interference or sliding friction fit between the top sidewall and the bottom sidewall and can act as the sole restraining member for the dispenser or be combined with another restraining member such as the flexible substrate 58. Due to the interference fit, the top portion of the dispenser will remain in position as the stack of sheets is depleted until a force is applied to the top panel to lower the top portion. Such a feature can be desirable for weaker and/or stiffer sheets that may not dispense properly when the top panel touches the stack within the dispenser.

If desired, any of the dispensers in FIGS. 1–6 can be provided with a spacer(s) 66 (FIG. 6) attached to the top portion that can rest on or contact only a portion of the stack 23. The spacer can maintain a clearance height $H_c$ between the top of the stack 23 and the top panel 32. The clearance can help with dispensing various sheet materials by providing a small gap between the stack 23 and the dispensing opening 36. The gap can be useful when retrieving sheet materials during reach-in dispensing or for pop-up dispensing to ensure greater reliability. As the top portion is adjusted, the spacer(s) will maintain a minimum gap until the sheet material is fully depleted. One or more spacers can be located along the length of the stack. For example, two spacers can be used with one spacer located near each end of the stack just outboard of the dispensing opening 36 in the top portion 30. In one embodiment, the spacers were formed from the same carton material as the top portion and had the same thickness as the top panel. In various embodiments, the clearance height $H_c$ can be between about 1 mm to about 30 mm, or between about 1 mm to about 20 mm, or between about 1 mm to about 10 mm.

The top and bottom sidewalls of the dispenser can be any shape or size that will telescope or nest. Any suitable geometric nesting/telescoping shape can be used. Suitable shapes can include triangular, square, rectangular, pentagon, hexagon, octagon, oval, circular, star shaped or fluted. The overall size of the dispenser and the shape of the sidewalls can be designed as needed to properly dispense the sheet material placed within the dispenser. The size and shape of the dispenser can be influenced by the size of the sheet material being dispensed, how the sheets are folded prior to placement in the dispenser, the number of sheets placed into the dispenser, the orientation of the stack and configuration of the stack within the dispenser, and the characteristics of the material being dispensed. Often more than one acceptable shape will work to properly dispense the sheet material.

In one embodiment, the top panel and bottom panel comprised rectangles having an approximate size of 24 cm long by 12 cm wide recognizing that the panels may be slightly larger or smaller relative to each other depending on whether the top portion nests into the bottom portion or instead the bottom portion nests into the top portion. The top and bottom sidewalls in this embodiment comprised two pairs of opposing panels attached to the top and bottom panels as illustrated in FIG. 1. One pair of opposing sidewalls comprised panels having a height of approximately 5.5 cm and a depth of approximately 12 cm. The other pair of opposing sidewalls comprised panels having a height of approximately 5.5 cm and a length of approximately 24 cm. Such a size is useful for dispensing standard size facial tissue sheets in a flat carton when folded into a stack and placed within the dispenser. The initial height of the dispenser was approximately 11 cm and the final height was approximately 5.5 cm. With the top and bottom portions attached together, the dispenser comprised a rectangular box.

In another embodiment, the top panel and bottom panel comprised squares having an approximate size of 11 cm long by 11 cm wide recognizing that the panels may be slightly larger or smaller relative to each other depending on whether the top portion nests into the bottom portion or instead the bottom portion nests into the top portion. One pair of opposing sidewalls comprised panels having a height of approximately 6.5 cm and a depth of approximately 11 cm. The other pair of opposing sidewalls comprised panels having a height of approximately 6.5 cm and a length of approximately 11 cm. Such a size is useful for dispensing standard size facial tissue sheets in an upright carton when folded into a stack and placed within the dispenser. The tissue or sheet material can be folded into quarter sheet size by folding once in half and then folding once more in half again. The quarter sheet size tissues can be interleaved to provide pop-up dispensing. Such is believed to hold more tissues than a standard upright dispenser where the stack is folded into a U shape since interior volume is more efficiently filled with less wasted space. The initial height of the dispenser was approximately 13 cm and the final height was approximately 6.5 cm. With the top and bottom portions attached together, the dispenser comprised a cube.

The restraining member 46 and/or seal 62 can be located along any portion of the top and bottom sidewalls. For example, either or both may be located along the entire perimeter of the top and bottom sidewalls. Alternatively, the seal can be eliminated and the restraining member located along just a portion of the perimeter such as along the top of the longer opposing panels forming the sidewalls in FIG. 1. Alternatively, the seal can extend along the entire perimeter and the restraining member along just a portion. In yet another embodiment, the seal can be located along one portion of the perimeter and the restraining member along another portion. For example, in FIG. 1, the restraining member may be located along the longer sidewall portions while the seal is located along the shorter sidewall portions of the opposing sidewall panels. Alternatively, the restraining member can be located along the shorter sidewall portions and the seal located along the longer sidewall portions.

When housing a wet sheet material, the flexible restraining member 58 can be selected from a moisture impervious material and located along the entire perimeter between the upper and lower portions and attached or sealed to both the upper and lower portions to prevent moisture loss while still allowing the dispenser's height to be adjusted. Alternatively, the fit 64 can be a sliding or interference fit that prevents moisture loss. Alternatively, resilient or elastic materials for the projections (48, 50) can be used such that they contact the opposing sidewall similar to a wiper blade thereby preventing moisture loss.

The various components of the dispenser can be made from any suitable flexible material that can bend or flex with minimal applied forces or from a rigid material. Suitable flexible materials can include polyethylene, polyester, polypropylene, polyvinyl chloride, polyamide, acetate, cellophane, rubber, elastomeric materials, or metal foils, amongst other suitable alternatives. The film can be single layer, a laminate of the above materials, or a laminate with a metal foil layer. Suitable rigid materials can include cardboard, carton stock, paper board, polypropylene, polyethylene, polystyrene, ABS plastic, plastic, metal, wood, and glass amongst other suitable alternatives. The dispenser can include a combination of flexible and rigid materials.

The dispenser can be either durable or disposable with either optionally refillable by selecting the type of materials forming the dispenser considering their durability. For example, plastic materials can be used to make a durable refillable dispenser and top and bottom portions can be separated by overcoming action of the restraining member such as the upper and lower projections by bending or flexing the sidewalls to separate the two portions.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A dispenser comprising:

a bottom portion including a bottom panel and a bottom sidewall extending from the bottom panel and having a bottom sidewall height;

a top portion having a top panel and a top sidewall extending from the top panel and having a top sidewall height and at least one spacer attached to the top portion for maintaining a clearance height Hc between the top panel and a stack of sheet material within the dispenser;

a dispensing opening located in the top panel;

the bottom portion at least partially nested within the top portion such that an overall height of the dispenser can be reduced as the top portion moves relative to the bottom portion;

a restraining member preventing the bottom portion and the top portion from separating; and wherein a ratio of the bottom sidewall height to the top sidewall height is between about 0.6 to about 2.

2. A dispenser comprising:

a bottom portion including a bottom panel and a bottom sidewall extending from the bottom panel and having a bottom sidewall height;

a top portion having a top panel and a top sidewall extending from the top panel and having a top sidewall height and at least one spacer attached to the top portion for maintaining a clearance height Hc between the top panel and a stack of sheet material within the dispenser;

a dispensing opening located in the top panel;

the top portion at least partially nested within the bottom portion such that an overall height of the dispenser can be reduced as the top portion moves relative to the bottom portion;

a retaining member preventing the bottom portion and the top portion from separating; and wherein a ratio of the bottom sidewall height to the top sidewall height is between about 0.6 to about 2.

3. The dispenser of claim 1 or 2 wherein the top sidewall and the bottom sidewall each comprise at least two pairs of opposing sidewall panels.

4. The dispenser of claim 1 or 2 wherein the top sidewall and the bottom sidewall each comprise a circular or oval shape.

5. The dispenser of claim 1 or 2 wherein the restraining member comprises a flexible substrate applied to at least a portion of both the top and bottom sidewalls.

6. The dispenser of claim 1 or 2 wherein the restraining member comprises an extension of a dispensing window attached to the top panel and extending past the top sidewall and attached to the bottom sidewall.

7. The dispenser of claim 1 or 2 wherein the restraining member comprises a lower projection on the bottom sidewall and an upper projection on the top sidewall.

8. The dispenser of claim 7 wherein the upper and lower projections are triangular in shape.

9. The dispenser of claim 7 wherein the upper and lower projections are L shaped.

10. The dispenser of claim 7 wherein the upper projection comprises at least two projections separated by a gap and the lower projection resides in the gap between the projections.

11. The dispenser of claim 1 or 2 wherein the restraining member comprises an interference fit between the top and bottom sidewalls such that the top and bottom portions are held together by frictional contact and the top portion will move lower only when an external force is applied.

12. The dispenser of claim 1 or 2 comprising a clearance fit between the top sidewall and the bottom sidewall such that the top portion will lower automatically without an applied external force.

13. The dispenser of claim 1 or 2 wherein the overall height H of the dispenser is reduced by approximately one-half from the initial height $H_i$ to the final height $H_f$.

14. The dispenser of claim 1 or 2 further comprising a seal between the top sidewall and the bottom sidewall that initially prevents movement of the top portion relative to the bottom portion until the seal is broken.

15. The dispenser of claim 14 wherein the seal comprises a removable strip.

16. The dispenser of claim 14 wherein the seal comprises an adhesive connection between the top portion and the bottom portion.

17. The dispenser of claim 1 or 2 wherein the stack of sheet material comprises a stack of wet sheet material contained within the dispenser.

18. The dispenser of claim 17 wherein the restraining member seals the top portion to the bottom portion to reduce moisture loss of the wet sheet material.

19. The dispenser of claim 1 or 2 wherein the ratio of the bottom sidewall height to the top sidewall height is between about 0.8 to about 1.2.

20. A dispenser comprising:

a bottom portion including a bottom panel and a bottom sidewall extending from the bottom panel and having a bottom sidewall height;

a top portion having a top panel and a top sidewall extending from the top panel and having a top sidewall height;

a dispensing opening located in the top panel;

the bottom portion and top portion having the ability to telescope changing an overall height of the dispenser, and a restraining member comprising a flexible substrate preventing the bottom portion and the top portion from separating.

21. The dispenser of claim 20 wherein the flexible substrate is applied to at least a portion of an interior of the top portion and at least a portion of an interior of the bottom portion.

22. The dispenser of claim 20 wherein the restraining member comprises an extension of a dispensing window attached to the top panel and extending past the top sidewall and attached to the bottom sidewall.

23. A dispenser comprising:

a bottom portion including a bottom panel and a bottom sidewall extending from the bottom panel and having a bottom sidewall height;

a top portion having a top panel and a top sidewall extending from the top panel and having a top sidewall height;

a dispensing opening located in the top panel;

the bottom portion and top portion having the ability to telescope changing an overall height of the dispenser, and a restraining member comprising a lower triangular projection on the bottom sidewall and an upper triangular projection on the top sidewall preventing the bottom portion and the top portion from separating.

24. The dispenser of claim 23 wherein the upper projection comprises at least two triangular projections separated by a gap and the lower triangular projection resides in the gap between the at least two upper triangular projections.

* * * * *